US005250125A

United States Patent [19]

Koch et al.

[11] Patent Number: 5,250,125

[45] Date of Patent: Oct. 5, 1993

[54] PROCESS FOR GRAIN REFINEMENT OF ALUMINIUM CASTING ALLOYS, IN PARTICULAR ALUMINIUM/SILICON CASTING ALLOYS

[75] Inventors: Hubert Koch, Rheinfelden, Fed. Rep. of Germany; Jean-Claude Jaquet, Schaffhausen, Switzerland; Ulrich Hielscher, Rheinfelden, Fed. Rep. of Germany

[73] Assignee: Alusuisse-Lonza Services Ltd., Zurich, Switzerland

[21] Appl. No.: 959,448

[22] Filed: Oct. 13, 1992

[30] Foreign Application Priority Data

Oct. 23, 1991 [CH] Switzerland ..... 3092/91

[51] Int. Cl.[5] ..... C22C 1/00

[52] U.S. Cl. ..... 148/549; 148/548

[58] Field of Search ..... 148/549, 548

[56] References Cited

U.S. PATENT DOCUMENTS

| | | | |
|---|---|---|---|
| 1,940,922 | 12/1933 | Sterner-Rainer | 75/685 |
| 3,953,202 | 4/1976 | Rasmussen | 420/548 |
| 4,113,473 | 9/1978 | Gauvry et al. | 420/548 |
| 5,023,051 | 6/1991 | Lindberg | 420/548 |

FOREIGN PATENT DOCUMENTS

| | | | |
|---|---|---|---|
| 0069680 | 1/1983 | European Pat. Off. . | |
| 0009662 | 6/1964 | Japan | 420/548 |
| 0031530 | 10/1970 | Japan | 420/548 |
| 9105069 | 4/1991 | World Int. Prop. O. . | |

OTHER PUBLICATIONS

Chemical Abstracts, vol. 81, No. 24, Abstract No. 157202, by Sap'yan et al., for Effect of Phosphides on the Structure and Properties of Hypereutectoid Silumins.

Zeitschrift Fur Metallkunde, Bd. 57, Nr. 5, May 5, 1966, for The Effect of Various Elements on the Modification of Al-Si Alloys, by S. T. Chiu.

*Primary Examiner*—Upendra Roy

*Attorney, Agent, or Firm*—Bachman & LaPointe

[57] ABSTRACT

For the grain refinement of aluminum casting alloys, in particular aluminum/silicon casting alloys, gallium phosphide and/or indium phosphide are/is added to the melt, optionally in addition to further grain-refinement and/or modification additions. The addition of gallium phosphide and/or indium phosphide results in a good grain refinement with low shrink-hole tendency and does not have an adverse effect on modification processes.

12 Claims, No Drawings

PROCESS FOR GRAIN REFINEMENT OF ALUMINIUM CASTING ALLOYS, IN PARTICULAR ALUMINIUM/SILICON CASTING ALLOYS

BACKGROUND OF THE INVENTION

The invention relates to a process for the grain refinement of aluminum casting alloys, in particular aluminium/silicon casting alloys, by nucleating additions of phosphorus-containing substances to the melt.

Depending on solidification type and solidification cycle, a coarse-grained microstructure which has lower strength and ductility than fine-grained microstructure may occur in aluminum alloys. A fine-grained microstructure having better mechanical properties and improved castability can be achieved by nucleating additions to the melt. The grain-refinement agents added react in the melt in accordance with complex processes and act as foreign nuclei.

In hypereutectic aluminum/silicon alloys, the grain refinement takes place as a result of phosphorus addition. This involves the refinement of the initially precipitated silicon by aluminum phosphide nuclei. The phosphorus addition takes place as phosphorus pentachloride, in the form of preparations containing red phosphorus and hexachloroethane or as copper and/or iron phosphide.

In hypoeutectic and eutectic aluminum/silicon alloys, a finely structured eutectic is achieved by the so-called modification of the lamellar or grained eutectic microstructure. The modification takes place by addition of sodium or strontium to the melt and effects a refinement of the eutectically precipitated silicon. Critical for the appearance of the lamellar or grained microstructure are the cooling rate and the presence of certain elements in low concentration. Thus, a low phosphorus content is decisive for the grained microstructure.

The addition of phosphorus to the melt in the form of preparations containing phosphorus pentachloride or red phosphorus does not always result in the desired fine-grained structure of the silicon. An addition as copper phosphide or iron phosphide is not possible if copper or iron are undesirable as accompanying elements.

SUMMARY OF THE INVENTION

In view of these facts, the inventor has set himself the object of providing a process of the type discussed above which does not have the disadvantages mentioned.

The object is achieved, according to the invention, in that gallium phosphide and/or indium phosphide are/is added to the melt.

It has been found that a substantially improved grain-refinement effect is achieved in relation both to the initially precipitated silicon particles in hypereutectic and to eutectically precipitated silicon particles in hypoeutectic and eutectic alloys is achieved by the addition of gallium phosphide and/or indium phosphide, which results in a substantial improvement of the castability and of the mechanical properties of the alloys.

DESCRIPTION OF PREFERRED EMBODIMENTS

To ensure the desired grain-refinement effect, the addition of gallium phosphide and/or indium phosphide takes place preferably in an amount which corresponds to an addition of 1 to 250 ppm of phosphorus, relative to the melt. In this connection, even an amount of about 1 to 30 ppm of phosphorus is sufficient in hypoeutectic and eutectic alloys. A higher amount, which also rises with increasing silicon content in accordance with the availability of a higher number of nuclei, is necessary in the case of hypereutectic alloys. In practice, it is preferably between about 30 and 150 ppm of phosphorus and in the case of piston alloys having a silicon content of about 13 to 17% by weight it is, for example, 70 to 80 ppm of phosphorus.

It has been found that the addition of gallium phosphide and/or indium phosphide to other grain-refinement and/or modification additions has an additive effect and does not, in particular, adversely effect the modification processes.

The addition of gallium phosphide and/or indium phosphide to the melt can take place in the known ways of adding grain-refinement agents, that is to say, for example, in pure form or in the form of substances containing gallium phosphide and/or indium phosphide, as tablets or as prealloys in wire or pig form. An aluminum/gallium phosphide and/or indium phosphide alloy or an aluminum silicon/gallium phosphide and/or indium phosphide alloy may be used as prealloy, it also being possible for the prealloy to be produced by powder metallurgy. The proportion of gallium phosphide and/or indium phosphide in the prealloy is preferably between 0.3 and 50% by weight, in particular between about 1 and 10% by weight.

In connection with the present invention, aluminum/silicon casting alloys are understood as meaning aluminum casting alloys containing silicon as main alloying element. The concept of aluminum/silicon casting alloys consequently also implies alloys containing further alloying elements, special additions and commercial impurities, and comprises both primary and remelted alloys. Depending on the field of application, the silicon content of aluminum/silicon casting alloys is between about 2 and 25% by weight.

The invention is explained in greater detail below by reference to two examples.

EXAMPLE 1

70 kg of an alloy of the type AlSi17Cu4Mg having the composition (% by weight)

| | | | |
|---|---|---|---|
| Si | 16.2 | Fe | 0.2 |
| Cu | 4.4 | Ti | 0.1 |
| Mg | 0.6 | Al | remainder |

is melted at 760° C. in an induction furnace. An addition of 70 ppm of P as GaP in pure form took place to one portion of the melt. After a soaking time of 90 min, both melts were cast as round pins of 30 mm diameter. Metallographic microsections were prepared from the pins obtained and the particle diameter of the initially precipitated silicon particles was determined.

The average particle diameter was 60 μm in the case of the alloy without GaP addition and 21 μm in the case of the alloy with GaP addition.

EXAMPLE 2

30 kg of an alloy of the type AlSi12Mg(Sr) having the composition (% by weight)

| | | | |
|---|---|---|---|
| Si | 10.8 | Sr | 0.04 |
| Mg | 0.2 | Al | remainder |

were melted at 730° C. in an induction furnace. An addition of 8 ppm of P as GaP in pure form took place to one portion of the melt. After a soaking time of 60 min, 12 mm thick cast specimens of size 13 cm×13 cm were produced from both melts. The particle diameter of the eutectic grains was determined on the surface in the specimens obtained. The average grain size was 2.7 mm in the case of the alloy without GaP additions and 0.7 mm in the case of the alloy with GaP addition.

We claim:

1. Process for the grain refinement of aluminum casting alloys, which comprises adding to a melt of an aluminum casting alloy nucleating additions of phosphorus-containing substances, wherein the phosphorus-containing substances are selected from the group consisting of gallium phosphide, indium phosphide and mixtures thereof, and wherein the nucleating addition corresponds to 1 to 250 ppm of phosphorus, relative to the melt.

2. Process according to claim 1 including the step of adding the nucleating additions to a melt of an aluminum silicon casting alloy.

3. Process according to claim 1 wherein, in the case of hypoeutectic and eutectic alloys, the nucleating addition corresponds to an amount of 1 to 30 ppm of phosphorus, relative to the melt.

4. Process according to claim 1 wherein, in the case of hypereutectic alloys, the nucleating addition corresponds to an amount of 30 to 150 ppm of phosphorus relative to the melt.

5. Process according to claim 2 wherein a material selected from the group consisting of a grain-refinement addition, a modification addition and mixtures thereof are added to the nucleating addition.

6. Process according to claim 2 wherein the nucleating addition is added to the melt in pure form.

7. Process according to claim 2 wherein the nucleating addition is added to the melt in the form of at least one substance which contains a phosphorus-containing substance selected from the group consisting of gallium phosphide, indium phosphide and mixtures thereof.

8. Process according to claim 2 wherein the nucleating addition is added to the melt in tablet form.

9. Process according to claim 2 wherein the nucleating addition is added to the melt as a material selected from the group consisting of aluminum/gallium phosphide, indium phosphide prealloy, aluminum silicon/-gallium phosphide, indium phosphide prealloy and mixtures thereof.

10. Process according to claim 9 wherein the proportion of gallium phosphide and indium phosphide in the prealloy is 0.3 to 50% by weight.

11. Process according to claim 9 wherein the nucleating addition to the melt takes place as prealloy in wire or pig form.

12. Process according to claim 10 wherein said proportion is 1 to 10% by weight.

* * * * *